US011052665B2

(12) United States Patent
Mizuno

(10) Patent No.: US 11,052,665 B2
(45) Date of Patent: Jul. 6, 2021

(54) LIQUID DISCHARGING HEAD

(71) Applicant: Brother Kogyo Kabushiki Kaisha, Nagoya (JP)

(72) Inventor: Taisuke Mizuno, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/835,469

(22) Filed: Mar. 31, 2020

(65) Prior Publication Data

US 2020/0384774 A1 Dec. 10, 2020

(30) Foreign Application Priority Data

Jun. 6, 2019 (JP) ..... JP2019-106406

(51) Int. Cl.
*B41J 2/175* (2006.01)

(52) U.S. Cl.
CPC ..... *B41J 2/175* (2013.01)

(58) Field of Classification Search
CPC ..... B41J 2/175; B41J 2/14427; B41J 2002/14419; B41J 2/14233
USPC ..... 347/54, 68, 84, 85, 94
See application file for complete search history.

(56) References Cited

U.S. PATENT DOCUMENTS 7,712,885 B2 * 5/2010 Kojima ..... B41J 2/055 347/94
8,167,420 B2 * 5/2012 Hibi ..... B41J 2/1609 347/94
9,162,454 B2 * 10/2015 Xie ..... B41J 2/055
10,549,539 B2 * 2/2020 Katayama ..... B41J 2/14209
2020/0189274 A1 * 6/2020 Hayashi ..... B41J 2/1433

FOREIGN PATENT DOCUMENTS

JP 2010-188547 A 9/2010

* cited by examiner

*Primary Examiner* — An H Do
(74) *Attorney, Agent, or Firm* — Banner & Witcoff, Ltd.

(57) ABSTRACT

A liquid discharging head, having a plurality of individual flow paths, a common flow path, a damper, a heater pattern, a heat source, and a connecting pattern, is provided. The individual flow paths are arrayed in a first direction. The common flow path extends in the first direction throughout the individual flow paths and is connected with the individual flow paths. The damper extends in the first direction throughout the individual flow paths. A part of the damper forms an inner face that defines an end of the common flow path in a second direction. The heater pattern is provided to the damper. The connecting pattern connects the heater pattern with the heat source. In a range, in which in the first direction the individual flow paths are arranged, the heater pattern extends in the first direction without inclining with respect to the first direction at 45 degrees or larger.

12 Claims, 7 Drawing Sheets

VERTICAL DIRECTION

CONVEYING DIRECTION

LIQUID DISCHARGING HEAD

CROSS REFERENCE TO RELATED APPLICATION

This application claims priority from Japanese Patent Application No. 2019-106406, filed on Jun. 6, 2019, the entire subject matter of which is incorporated herein by reference.

BACKGROUND

Technical Field

An aspect of the present disclosure is related to a liquid discharging head capable of discharging liquid through nozzles.

Related Art

A liquid discharging head capable of discharging liquid through nozzles, such as an inkjet recording head capable of discharging ink through nozzles, is known. The inkjet recording head may have a plurality of individual flow paths, each of which includes a nozzle and a pressure chamber. The individual flow paths may array in line extending in one direction and communicate with a common liquid chamber, which extends in the same direction as the array of the individual flow paths. An upper face, or a roof, of the common liquid chamber may include a heater that may also function as a damper. The heater may be made of layered polyimide films with patterned copper wires interposed there-between.

SUMMARY

Since the damper having the function of the heater contains the patterned heat conductor, the damper may be inevitably rigid. Therefore, compared to a damper without the patterned heat conductor, the damper with the patterned heat conductor may be less flexible and provide a smaller effect to absorb pressure fluctuation of the ink in the common liquid chamber. In order to reduce rigidity of the damper having the function of a heater, a coarse arrangement of the patterned heat conductor may be suggested; however, a specifically preferable arrangement of the pattern has not been suggested.

The present disclosure is advantageous in that a liquid discharging head, in which a damper is provided with a heater pattern while deformation of the damper may not be inhibited, is provided.

According to an aspect of the present disclosure, a liquid discharging head, having a plurality of individual flow paths, a common flow path, a damper, a heater pattern, a heat source, and a connecting pattern, is provided. Each of the plurality of individual flow paths includes a nozzle. The plurality of individual flow paths are arrayed in a first direction. The common flow path extends in the first direction throughout the plurality of individual flow paths. The common flow path is connected with each of the plurality of individual flow paths. The damper extends in the first direction throughout the plurality of individual flow paths. The part of the damper forms an inner face that defines an end of the common flow path in a second direction. The second direction is orthogonal to the first direction. The heater pattern is provided to the damper. The connecting pattern connects the heater pattern with the heat source. At least in a range, in which in the first direction the plurality of individual flow paths are arranged, the heater pattern extends in the first direction without inclining with respect to the first direction at 45 degrees or larger.

BRIEF DESCRIPTION OF THE ACCOMPANYING DRAWINGS

Figure 3:
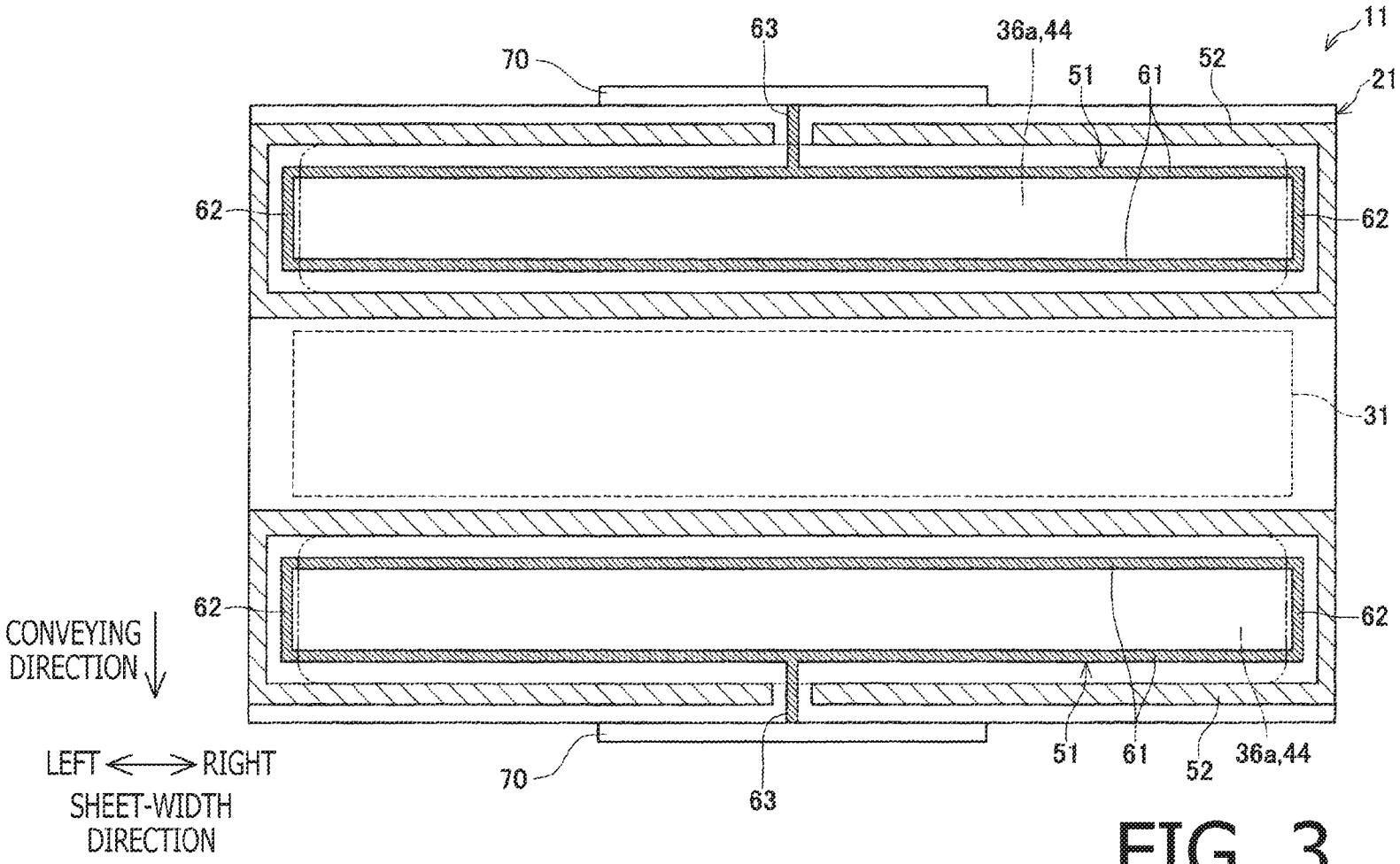

FIG. 3 is an illustrative view of the head unit 11 with first parts 51, second parts 52, heat sources 70, and common flow paths 44 according to the embodiment of the present disclosure.

Figure 2:
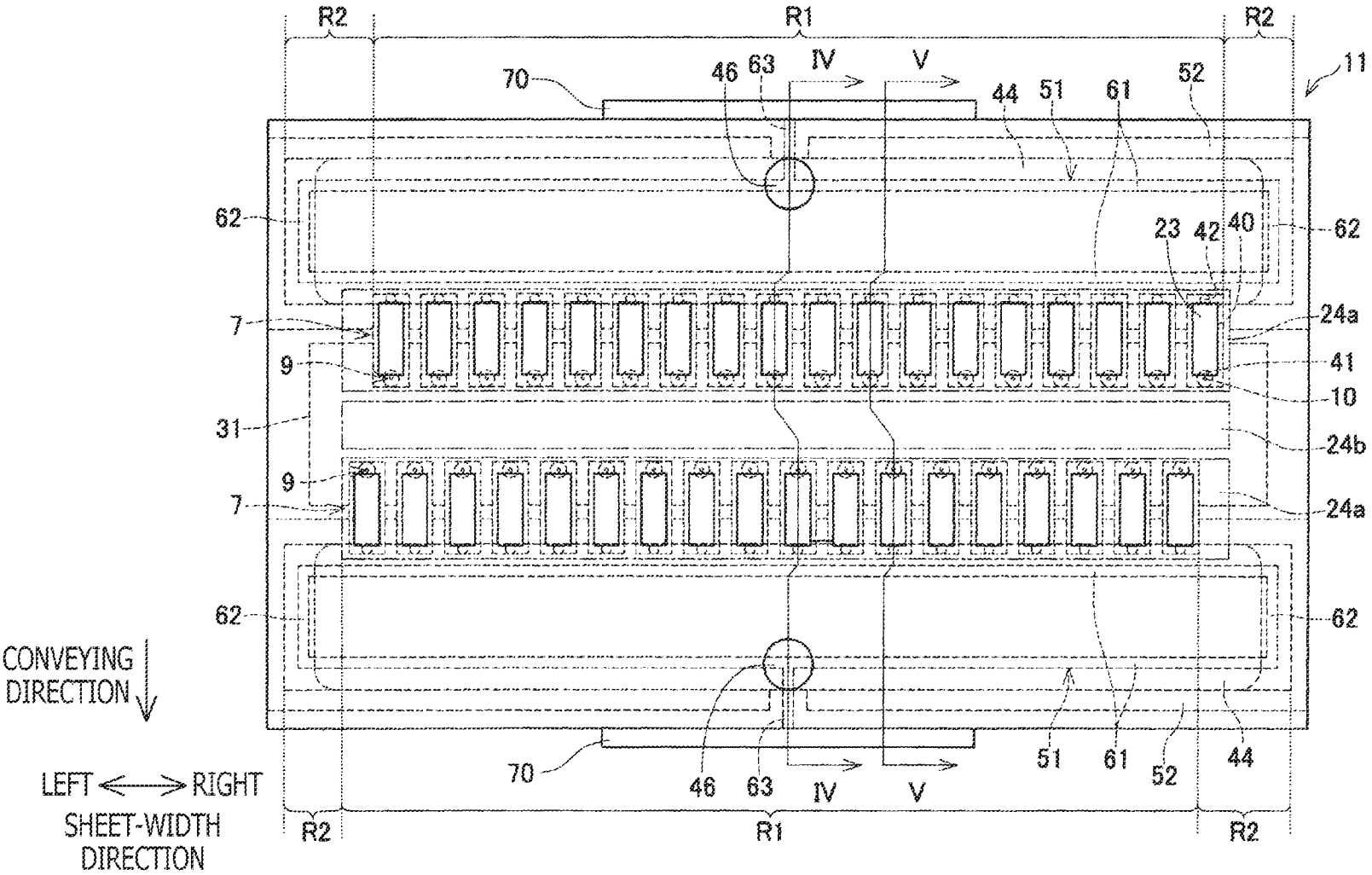
FIG. 2 is a plan view of a head unit 11 according to the embodiment of the present disclosure.
Figure 4:
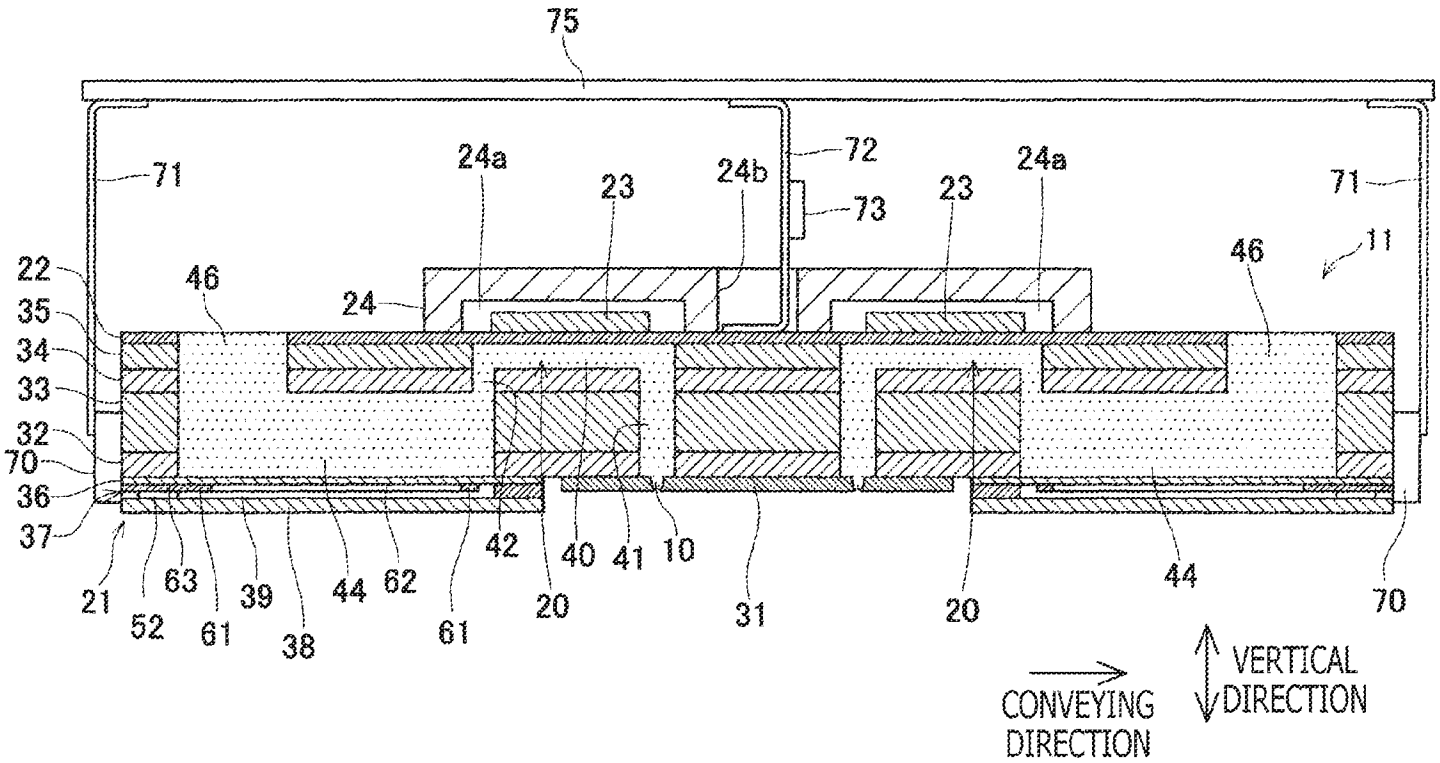

FIG. 4 is a cross-sectional view of the head unit 11 according to the embodiment of the present disclosure viewed along a line IV-IV shown in FIG. 2.

Figure 5:
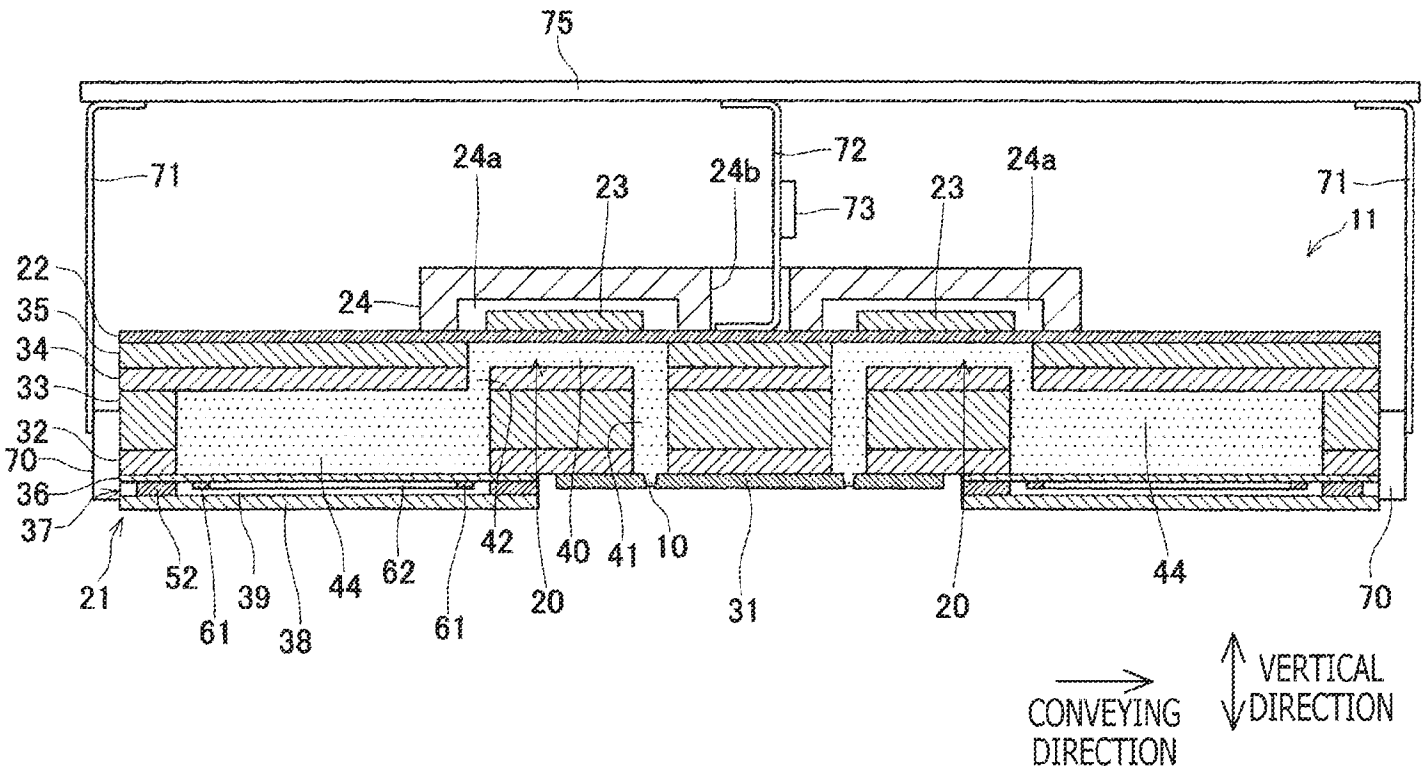

FIG. 5 is a cross-sectional view of the head unit 11 according to the embodiment of the present disclosure viewed along a line V-V shown in FIG. 2.

Figure 6:
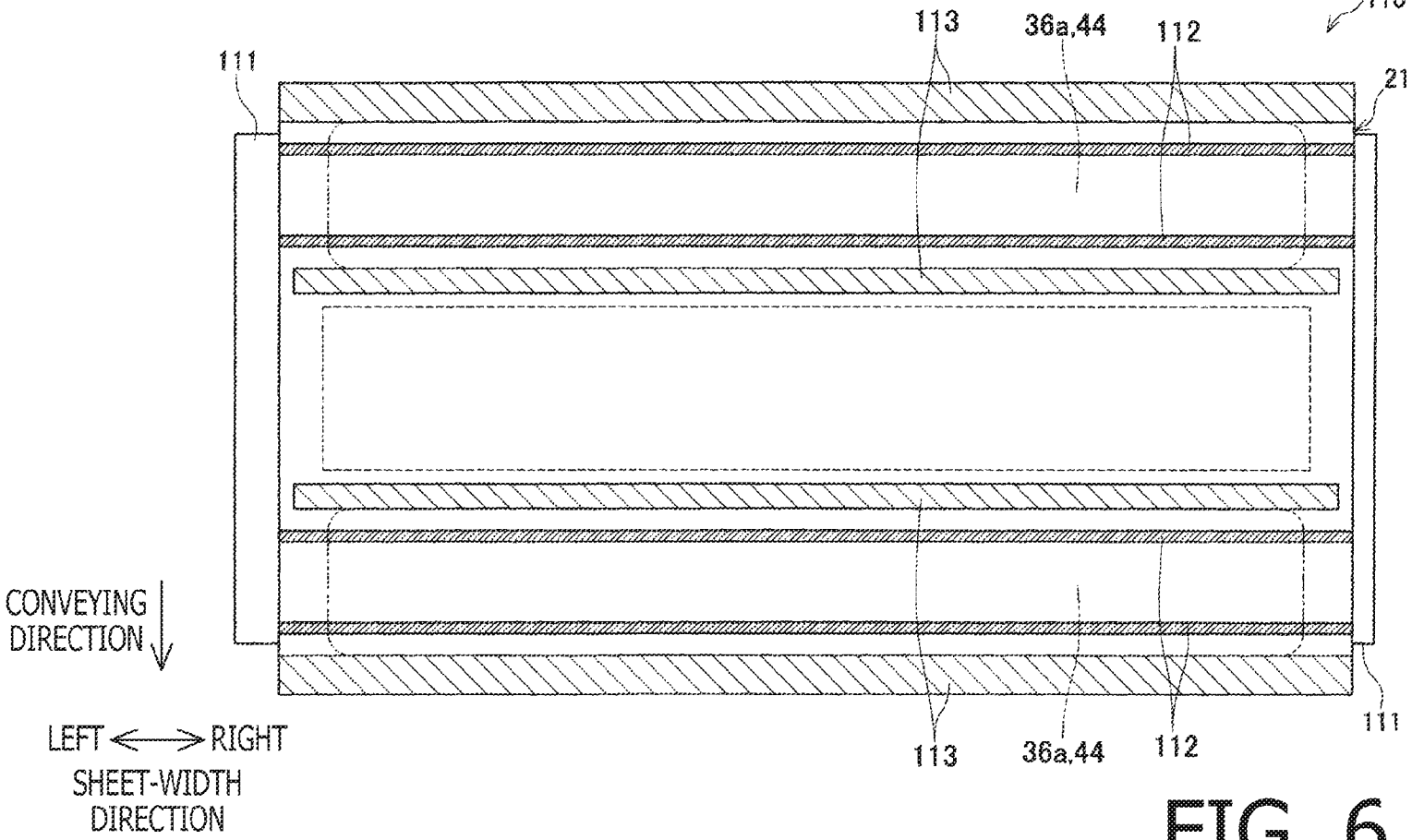

FIG. 6 is an illustrative view of a head unit 110 with patterns 112, second parts 113, heat sources 111, and the common flow paths 44 according to a first modified example of the embodiment of the present disclosure.

Figure 7A:
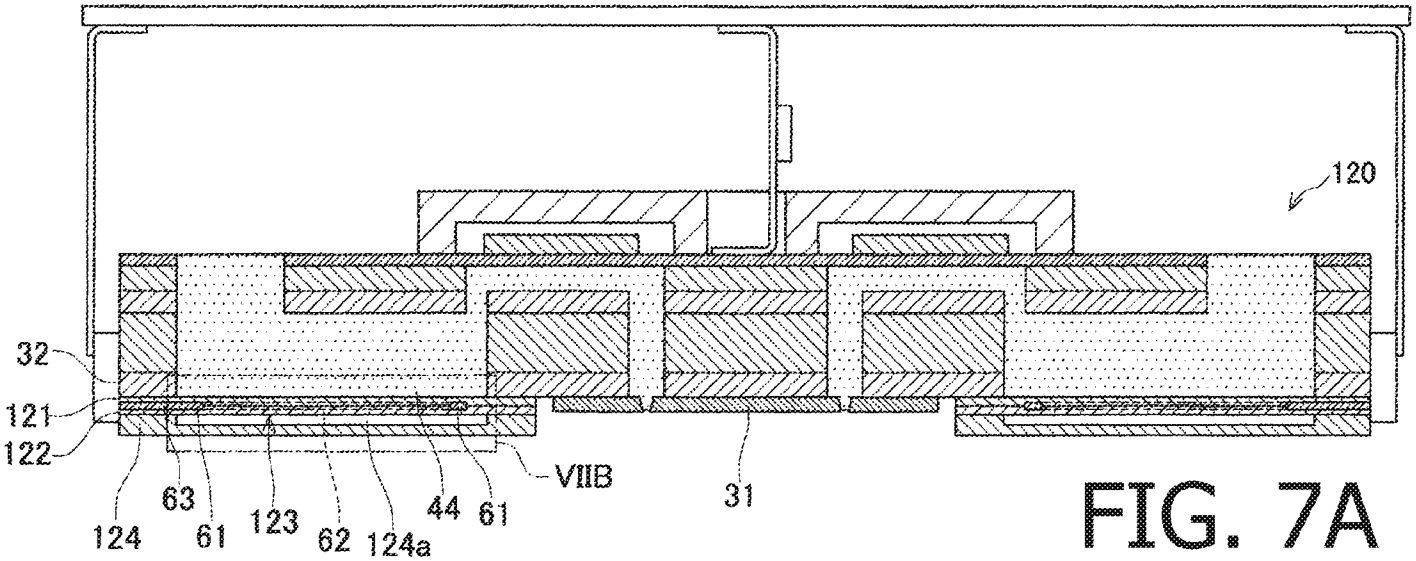
Figure 7B:
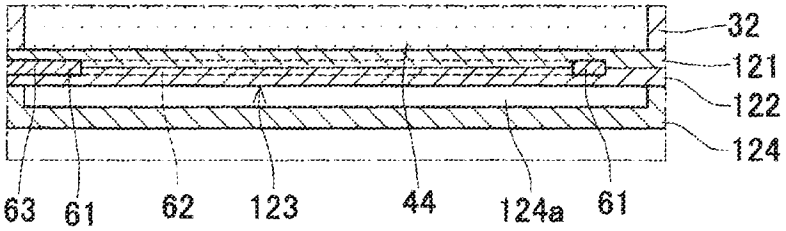

FIG. 7A is a cross-sectional view of a head unit 120 according to a second modified example of the embodiment of the present disclosure viewed at a position equivalent to the head unit 11 shown in FIG. 4. FIG. 7B is a partially enlarged view of an area VIIB shown in FIG. 7A.

DETAILED DESCRIPTION

In the following paragraphs, described will be an embodiment of the present disclosure.

<Overall Configuration of Printer 1>

Figure 1:
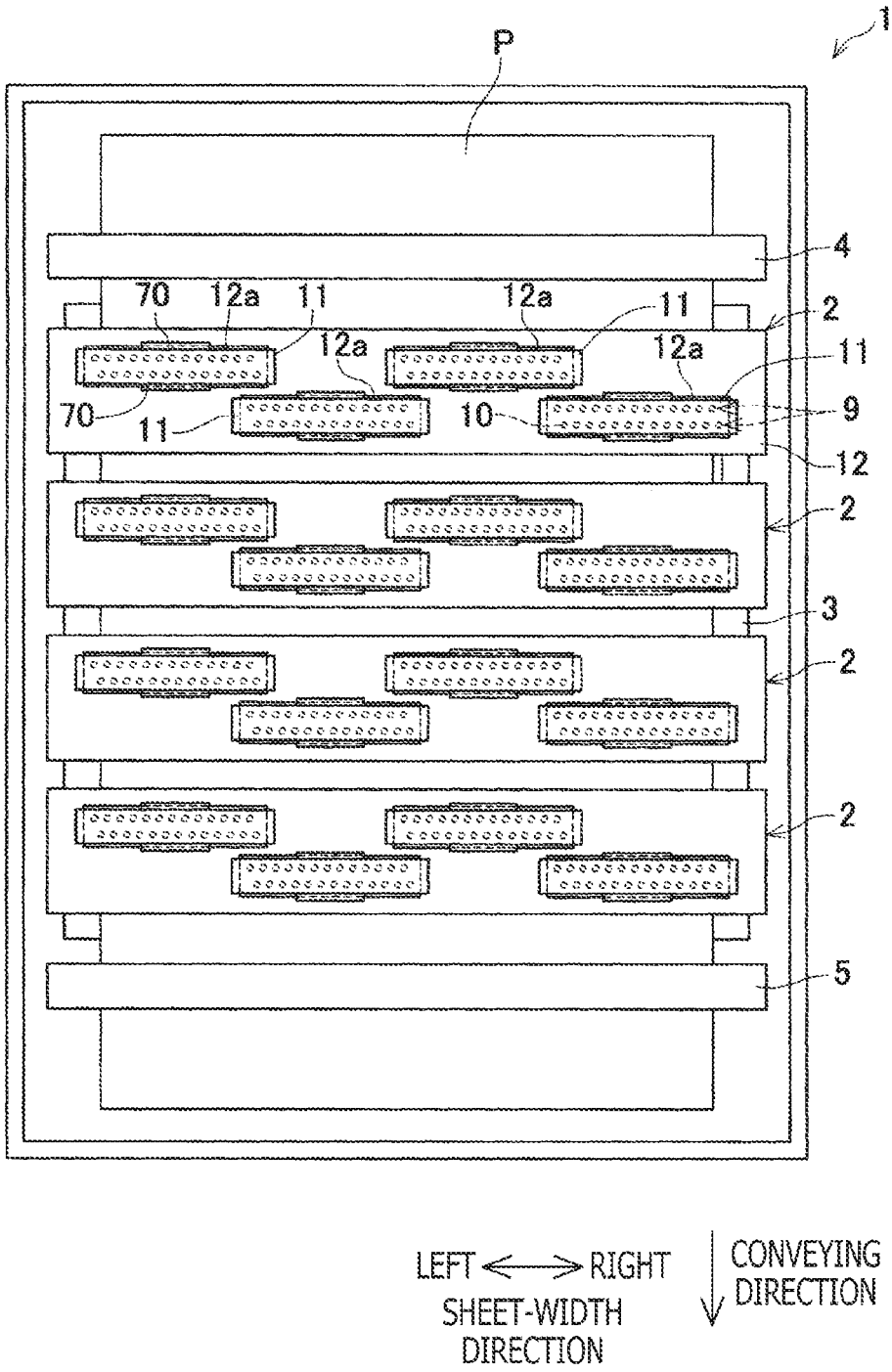
FIG. 1 is an overall plan view of a printer 1 according to an embodiment of the present disclosure.

As shown in FIG. 1, the printer 1 according to the embodiment includes four (4) inkjet heads 2, a platen 3, and conveyer rollers 4, 5.

The inkjet heads 2 align with a conveying direction, in which a recording sheet P is conveyed by the conveyer rollers 4, 5, as will be described below. Each inkjet head 2 includes four (4) head units 11 and a retainer member 12. Each head unit 11 may discharge ink through a plurality of nozzles 10, which are formed on a lower face thereof. The nozzles 10 of the head units 11 in each of the four inkjet heads 2 may discharge ink in one of different colors, which may be, from upstream to downstream in the conveying direction, black, yellow, cyan, and magenta.

In each head unit 11, the plurality of nozzles 10 are arrayed in a sheet-width direction, which is horizontal and orthogonal to the conveying direction. The plurality of nozzles 10 in each head unit 11 form two (2) nozzle arrays 9 aligning side by side in the conveying direction. Meanwhile, the nozzle arrays 9 in each head unit 11 are shifted from each other in the sheet-width direction for a half (½) of a distance between two (2) nozzles 10 that adjoin in the sheet-width direction. In the following paragraphs, relative positions in the sheet-width direction concerning items in the printer 1 may be expressed as rightward or leftward (see FIG. 1). Meanwhile, the sheet-width direction may include a left-to-right direction and a right-to-left direction.

In each inkjet head 2, two (2) and the other two (2) of the four (4) head units 11 arraying in the sheet-width direction are spaced apart from each other. Moreover, the array of the two head units 11 arraying in the sheet-width direction and the other array of the two head units 11 arraying in the sheet-width direction are spaced apart from each other in the conveying direction. Furthermore, the two head units 11 in the array on an upstream side in the conveying direction and the other two head units 11 in the array on a downstream side in the conveying direction are shifted from each other in the sheet-width direction. Moreover, some of the nozzles 10 in the head units 11 on the upstream side in the conveying direction and some of the nozzles 10 in the head units 11 on the downstream side overlap each other in the conveying direction. In this arrangement, the nozzles 10 in the four head units 11 are arranged throughout the width of the recording sheet P in the sheet-width direction. In this regard, the inkjet heads 2 are line heads, which extend longitudinally over the entire width of the recording sheet P in the sheet-width direction. The configuration of the head units 11 will be described further below.

The retainer member 12 in each inkjet head 2 is a rectangular plate with longitudinal sides thereof aligning with the sheet-width direction, and the four head units 11 are fixedly mounted thereon. In the retainer member 12, four (4) rectangular through holes 12*a* corresponding to the four head units 11 are formed. The nozzles 10 in the head units 11 are exposed to a lower side, i.e., toward the recording sheet P, through the through holes 12*a*.

The platen 3 is located on a lower side of the inkjet heads 2 to face the nozzles 10 in the head units 11. The platen 3 may support the recording sheet P from below. The conveyer roller 4 is located at a position upstream from the inkjet heads 2 and the platen 3 in the conveying direction. The conveyer roller 5 is located at a position downstream from the inkjet heads 2 and the platen 3 in the conveying direction. The conveyer rollers 4, 5 may convey the recording sheet P in the conveying direction.

The printer 1 may operate the conveyer rollers 4, 5 to convey the recording sheet P in the conveying direction and the inkjet heads 2 to discharge the ink through the nozzles 10 in the head units 11 to record an image on the recording sheet P.

<Head Units 11>

Next, one of the head units 11 will be representatively described below. As shown in FIGS. 2-5, the head unit 11 includes a flow path unit 21, a vibration board 22, a plurality of piezoelectric elements 23, and a protector board 24.

As shown in FIGS. 4 and 5, the flow path unit 21 includes plates 31-35, a synthetic resin layer 36, a metal layer 37, and a cover 38. The plate 31 may be made of, for example, a synthetic resinous material such as polyimide. The plates 32-35 may be made of, for example, silicon (Si). The plates 32, 33, 34, 35 are layered vertically in this given order from bottom to top. The plate 31 is attached to a central area on a lower face of the plate 32. A total thickness of the plates 31-35 may be, for example, 600-700 μm. In particular, for example, a thickness of the plate 31 may be 50 μm, a total thickness of the plates 32, 33 may be 400 μm, and a total thickness of the plates 34, 35 may be 200 μm.

By layering the plates 31-35, formed in the flow path unit 21 are the plurality of nozzles 10, a plurality of pressure chambers 40, a plurality of descenders 41, a plurality of funnels 42, and two (2) common flow paths 44.

The nozzles 10 are formed in the plate 31. The nozzles 10 are arranged to form the two (2) nozzle arrays 9 as mentioned above.

The pressure chambers 40 are formed in the plate 35 and are each provided in correspondence with one of the nozzles 10 individually. Each of the pressure chambers 40 has a rectangular shape, with longitudinal sides thereof aligning with the conveying direction, in a vertically projection view, and vertically overlaps the corresponding nozzle 10 partly at one end portion thereof on one side in the conveying direction. In particular, the pressure chamber 40 corresponding to the nozzle 10 in one of the nozzle arrays 9 on the downstream side in the conveying direction vertically overlaps the nozzle 10 at an end portion thereof on an upstream side in the conveying direction, and the pressure chamber 40 corresponding to the nozzle 10 in the other of the nozzle arrays 9 on an upstream side in the conveying direction vertically overlaps the nozzle 10 at an end portion thereof on a downstream side in the conveying direction.

The descenders 41 are each provided in correspondence with one of the nozzles 10 individually. Each descender 41 extends in the vertical direction through the plates 32-34 to connect the corresponding nozzle 10 with the pressure chamber 40.

The plurality of funnels 42 are formed in the plate 34 and are each provided in correspondence with one of the pressure chambers 40 individually. Each funnel 42 vertically overlaps the corresponding pressure chamber 40 at the other end portion of the pressure chamber 40 opposite to the one end portion, at which the pressure chamber 40 vertically overlaps the nozzle 10. The funnel 42 extends in the vertical direction and is connected with the corresponding pressure chamber 40 at an upper end thereof.

Thus, one of the nozzles 10, the pressure chamber 40 corresponding to the nozzle 10, the descender 41 corresponding to the nozzle 10, and the funnel 42 corresponding to the nozzle 10 form one of the individual flow paths 20. The plurality of individual flow paths 20 arrayed in the sheet-width direction form an individual flow path array 7. In each flow path unit 21, two (2) individual flow path arrays 7 align side by side in the conveying direction.

As shown in FIGS. 2-5, the two common flow paths 44 are provided to the two individual flow path arrays 7 and are formed through the plates 32, 33. In other words, the plates 32, 33 are formed to have the common flow paths 44.

Each common flow path 44 extends in the sheet-width direction throughout the entire length of the individual flow path array 7 and vertically overlaps the funnels 42 in the individual flow path array 7 at an end portion thereof on an inner side in a direction parallel to the conveying direction within the head unit 11. In other words, one of the common flow paths 44 on an upstream side in the conveying direction overlaps the individual flow path array 7 at an end portion thereof on a downstream side in the conveying direction, and the other of the common flow paths 44 on a downstream side in the conveying direction overlaps the individual flow path array 7 at an end portion thereof on an upstream side in the conveying direction. In this arrangement, the individual flow paths 20 are each connected with the overlapping common flow path 44 at the lower ends thereof. Meanwhile, on an outer side of each common flow path 44 in the direction parallel to the conveying direction, at a central area in the sheet-width direction, a supplying flow path 46 is connected with the common flow path 44. The supplying flow paths 46 extend vertically through the plates 34, 35 and are connected with ink tanks through tubes, which are not shown, so that the ink may be supplied from the tanks through the supplying flow paths 46 to the common flow paths 44.

As shown in FIGS. 4 and 5, the synthetic resin layer 36 is arranged on a lower face of the plate 32, in areas on outer sides from the plate 31 in the direction parallel to the conveying direction. The synthetic resin layer 36 is a sheet made of a synthetic resinous material, such as polyimide, having a thickness of, for example, 10-20 μm. Further, the synthetic resin layer 36 spread to vertically overlap the common flow paths 44 to close lower ends of the common flow paths 44. In other words, the parts of the synthetic resin layer 36 vertically overlapping the common flow paths 44 provide inner faces, or bottoms, of the common flow path 44. In this arrangement, the parts of the synthetic resin layer 36 vertically overlapping the common flow paths 44 and forming the inner faces that define the lower ends of the common flow paths 44 each constitute a damper 36*a*. Each damper 36*a* extends throughout the entire length of the common flow path 44 in the sheet-width direction and is deformable to absorb pressure fluctuation of the ink in the common flow path 44.

As shown in FIGS. 4 and 5, the metal layer 37 is arranged on a lower face of the synthetic resin layer 36. The metal layer 37 may be made of metallic a material such as, for example, copper, silver, gold, and aluminum, and has higher thermal conductivity than the synthetic resin layer 36. The metal layer 37 includes first parts 51 and second parts 52 (see FIGS. 2 and 3). A thickness of the second parts 52 is greater than a thickness of the first parts 51. In other words, a dimension of the first parts 51 in the vertical direction is smaller than a dimension of the second parts 52 in the second direction. For example, the first parts 51 may have a thickness of 20-30 μm, and the second parts 52 may have a thickness of 50-100 μm.

As shown in FIGS. 2-5, each first part 51 has heater patterns 61, linking patterns 62, and a connecting pattern 63. Two (2) heather patterns 61 are provided to each of the dampers 36*a*. One and the other of the two heater patterns 61 for each damper 36*a* vertically overlap one end portion and the other end portion of the damper 36*a* on one side and the other side in the direction parallel to the conveying direction, respectively. In other words, one and the other of the two heater patterns 61 for the same damper 36*a* are spaced apart from each other in the conveying direction and vertically overlap an upstream end portion and a downstream end portion of the damper 36*a* in the conveying direction, respectively. The heater patterns 61 for each damper 36*a* extend substantially in parallel with the sheet-width direction on the lower face of the synthetic resin layer 36 throughout the part that forms the damper 36*a* and the parts not forming the damper 36*a* but located on the outer sides from the damper 36*a*. In this arrangement, the heater patterns 61 extend throughout a range R1, in which the individual flow paths 20 in the individual flow path array 7 are arranged, and in ranges R2, which are on the outer sides from the individual flow paths 20. In this regard, the heater patterns 61 extending substantially in parallel with the sheet-width has no part that inclines at an angle of 45 degrees or larger with respect to the sheet-width direction at least in the range R1, in which the individual flow paths 20 are arranged.

As shown in FIGS. 2 and 3, to the two heater patterns 61 for each damper 36*a*, two (2) linking patterns 62 are arranged. The one and the other of the linking patterns 62 extend in the conveying direction to link rightward ends of the heater patterns 61 in the sheet-width direction with each other and leftward end of the heater patterns 61 in the sheet-width direction with each other, respectively. In this arrangement, the linking patterns 62 extend in the conveying direction in areas on the outer sides from the individual flow paths 20 and link the heater patterns 61 with each other.

As shown in FIGS. 2-5, the connecting pattern 63 is connected to one of the two heater patterns 61 provided to each damper 36*a*. In particular, the connecting pattern 63 is connected to the heater pattern 61 arranged on an outer side in the direction parallel to the conveying direction at a central area of the heater pattern 61 in the sheet-width direction. The connecting pattern 63 extends outward in the direction parallel to the conveying direction from the central area of the heater pattern 61 to an edge of the flow path unit 21. Meanwhile, heat sources 70 are each arranged on one and the other ends of the flow path unit 21 in the direction parallel to the conveying direction. In this arrangement, in a vertically projection view, the heat sources 70 are located on outer sides of the flow path unit 21 including the plates 32, 33, in which the common flow paths 44 are formed, in the direction parallel to the conveying direction. To each of the heat sources 70, the connecting pattern 63 is connected.

Moreover, as shown in FIGS. 4 and 5, wiring members 71 are connected to the heat sources 70. Each wiring member 71 extends upward from a position, at which the wiring member 71 is connected to the heat source 70, and is connected to a control board 75, which is arranged at an upper position with respect to the head unit 11. In this arrangement, the control board 75 may control temperatures in the heat sources 70.

Heat generated in the heat sources 70 may be transferred to the heater pattern 61 on the outer side in the direction parallel to the conveying direction and, through the linking patterns 62, further transferred to the heater pattern 61 on the inner side in the direction parallel to the conveying direction. Thus, the heat in the heater patterns 61 may heat the ink in the common flow path 44.

As shown in FIGS. 2-5, the second parts 52 of the metal layer 37 are arranged on the lower side of the synthetic resin layer 36 in areas vertically not overlapping the common flow paths 44. In other words, the second parts 52 are not arranged in the areas to vertically overlap the common flow paths 44. In this regard, the second parts 52 are each located in a joint area, in which the synthetic resin layer 36, the metal layer 37, and the plate 32 are joined.

Moreover, the second parts 52 located on the lower side of the synthetic resin layer 36 are arranged to avoid areas that vertically overlap outer ends of the synthetic resin layer 36 in the sheet-width direction. Therefore, the second parts 52 are not in contact with the heat sources 70. Furthermore, the second parts 52 are arranged to avoid the first parts 51 so that the second parts 52 is not connected with the first parts 51 directly. In other words, the first parts 51 and the second parts 52 may be separated from each other in a plan view as shown in FIG. 3.

As shown in FIGS. 4 and 5, the covers 38 are arranged on a lower face of the metal layer 37. The covers 38 may be made of, for example, SUS and are arranged to cover the dampers 36*a* and the heater patterns 61 from a lower side, i.e., a side opposite to the common flow paths 44. Between each damper 36*a* and the cover 38, formed is a damper chamber 39, which may absorb downward deformation of the damper 36*a*.

When the flow path unit 21 is fabricated, a layered piece including, for example, the synthetic resin layer 36 and a layer made of a metallic material to later form the metal layer 37 may be formed. Thereafter, parts of the metallic layer that will later form neither the first parts 51 nor the second parts 52 may be etched and removed. Moreover, parts of the metallic layer that will later form the first part 51 may be half-etched to be thinner. Thus, the layered piece including the synthetic resin layer 36 and the metal layer 37 may be formed. Thereafter, the layered piece including the synthetic resin layer 36 and the metal layer 37 may be joined to the lower face of the plate 32.

The vibration board 22 may be made of a material such as, silicon dioxide ($SiO_2$) or silicon nitride (SiN) and, as shown in FIGS. 4 and 5, is arranged on a lower face of the plate 35, to cover the pressure chambers 40. Meanwhile, upper ends of the supplying flow paths 46 are open upward from an upper face of the vibration board 22. A thickness of the vibration board 22 may be, for example, 1-2 μm.

The piezoelectric elements 23 are each provided in correspondence with one of the pressure chambers 40 individually. The piezoelectric elements 23 are arranged on an upper face of the vibration board 22 to vertically overlap central areas of the corresponding pressure chambers 40. Each piezoelectric element 23 may include, for example, a piezoelectric device made of a piezoelectric material, which includes a lead zilconate titanate being mixed crystal of lead titanate and lead zilconate as a primary component, and an electrode to operate on the piezoelectric device. As the piezoelectric elements 23 are operated, the piezoelectric elements 23 and parts of the vibration board 22 vertically overlapping the pressure chambers 40 may deform to dent into the corresponding pressure chambers 40. Thereby, volume of the pressure chambers 40 may be reduced, and the ink in the pressure chambers 40 may be pressurized so that the ink may be discharged through the nozzles 10 communicating with the pressure chambers 40. The configuration and behaviors of each piezoelectric elements 23 are similar to known conventional piezoelectric elements; therefore, detailed description of those will be herein omitted.

The protector board 24 is arranged on the upper face of the vibration board 22 and over the piezoelectric elements 23 that are arranged on the vibration board 22. The protector board 24 is formed to have two (2) raised portions 24*a* and a through hole 24*b*.

One and the other of the raised portions 34*a* correspond to one and the other of the individual flow path arrays 7, respectively. The raised portions 24*a* are open downward and extend over the entire length of the individual flow path arrays 7 in the sheet-width direction. Each raised portion 24*a* accommodates the piezoelectric elements 23 for the individual flow path array 7 that corresponds to the raised portion 24*a*.

The through hole 24*b* is arranged between the raised portions 24*a* in the conveying direction in the protector board 24. The through hole 24*b* is formed vertically through the protector board 24 and longitudinally extends in the sheet-width direction over the entire length of the individual flow path arrays 7. Therefore, a part of the upper face of the vibration board 22 is exposed through the through hole 24*b*. Meanwhile, on the exposed part of the upper face of the vibration board 22, wires (not shown) drawn from the piezoelectric elements 23 are arranged. Moreover, the wiring member 72 is joined to the exposed part of the upper face of the vibration board 22. Thereby, wires in the wiring member 72 are connected with the wires drawn from the piezoelectric elements 23.

The wiring member 72 extends upward from the exposed joint part of the vibration board 22 and is connected to the control board 75. On the wiring member 72, meanwhile, mounted is a driver IC 73. In this arrangement, the control bard 75 may control the driver IC 73 and operate the piezoelectric elements 23.

<Benefits>

According to the embodiment described above, as shown in FIGS. 2-5, the heater patterns 61 are arranged on each damper 36*a* that the bottom, or the inner face, to define the lower end of the common flow path 44 while the common flow path 44 extends in the sheet-width direction through the entire individual flow paths 20 that constitute the individual flow path array 7. The heater patterns 61 extend in the sheet-width direction throughout the range R1 in the sheet-width direction, in which the plurality of individual flow paths 20 are arranged. Therefore, the ink in the range R1, in which the plurality of individual flow paths 20 are arranged, may be evenly heated. As a result, temperature in the ink in the individual flow paths 20 may be evenly leveled.

Moreover, as shown in FIGS. 2 and 3, the heater patterns 61 extending substantially in parallel with the sheet-width direction throughout the range R1 in the sheet-width direction, in which the plurality of individual flow paths 20 are arranged, have no part that inclines at an angle of 45 degrees or larger with respect to the sheet-width direction. In other words, at least in the range R1, inclination of the heater patterns 61 is smaller than 45 degrees. Therefore, the heater patterns 61 may be restrained to a less extent from inhibiting deformation of the dampers 36*a*.

Moreover, as shown in FIGS. 4 and 5, while the upward face of the dampers 36*a* in the synthetic resin layer 36 form the bottoms, or the inner faces, of the common flow paths 44, the heater patterns 61, the linking patterns 62, and the connecting pattern 63 are arranged on the downward face of the synthetic resin layer 36 having the dampers 36*a*. In other words, the heater patterns 61, the linking patterns 62, and the connecting patterns 63 are arranged in a part of the synthetic resin layer 36 different from the part of the synthetic resin layer 36 that forms the inner faces of the common flow paths 44. Therefore, the heater patterns 61, the linking patterns 62, and the connecting pattern 63 may be restrained from being exposed to the ink in the common flow paths 44.

In contrast, for example, an alternative arrangement to arrange the heater patterns 61 merely within the range R1 in the sheet-width direction, in which the individual flow paths 20 forming the individual flow path array 7 are arrayed, may be considered. In this alternative arrangement, the temperature of the ink in parts of the common flow path 44 that are linked with the individual flow paths 20 located at widthwise ends in the sheet-width direction may be lower than the temperature of the ink in the part of the common flow path 44 that is linked with the individual flow paths 20 located at the center in the sheet-width direction. In other words, the temperatures in the ink may be uneven among different areas in the common flow path 44 in the sheet-width direction, and the temperatures in the ink may be uneven among the plurality of individual flow paths 20.

In this regard, according to the embodiment described above, as shown in FIGS. 2 and 3, the heater patterns 61 extend through the entire range R1 in the sheet-width direction, in which the individual flow paths 20 forming the individual flow path arrays 7 are arranged, and further to the ranges R2, which are on the outer sides of the range R1 in the sheet-width direction. Therefore, the heater patterns 61 extend in the sheet-width direction throughout the range, in which the individual flow paths 20 are arranged, and the sideward ranges, in which no individual flow path 20 is arranged. As a result, the temperatures in the ink in the parts where the common flow path 44 is connected with the individual flow paths may be evenly leveled, and the temperatures in the ink may be evenly leveled among the plurality of individual flow paths 20.

Moreover, according to the embodiment described above, as shown in FIGS. 2-5, each damper 36*a* is provided with two heater patterns 61, which vertically overlap the end portions of the damper 36*a* on one side and the other side in the conveying direction, respectively. Therefore, compared to an alternative arrangement, in which each damper 36*a* is provided with solely one (1) heater pattern 61, the ink in the common flow paths 44 may be efficiently heated. Furthermore, the arrangement of the two heater patterns 61 may restrain the heater patterns 61 from inhibiting deformation of the damper 36*a*.

Moreover, the damper 36*a* may be formed by etching the layered piece, which includes the synthetic resin layer 36 and the metallic layer to form the metal layer 37, to remove the parts of the metallic layer other than the parts that will form the first parts 51 and the second parts 52. Thus, the damper 36*a* with the heater patterns 61 may be fabricated in the simple procedure.

Moreover, as shown in FIGS. 2-5, the metal layer 37 may be formed to have not only the first parts 51, which include the heater patterns 61, the linking patterns 62, and the connecting pattern 63, but also the second parts 52, which are located within the joint area for the synthetic resin layer 36, the metal layer 37, and the plate 32 to be joined and which does not vertically overlap the common flow paths 44. Therefore, compared to an alternative arrangement, in which the metal layer 37 contains no second part 52, rigidity of the layered piece including the synthetic resin layer 36 and the metal layer 37 may be improved; therefore, during the procedure when the layered piece is attached to the plate 32, the layered piece may be handled more easily.

Moreover, as shown in FIGS. 2 and 3, on the metal layer 37, the first parts 51, including the heater patterns 61, the linking pattens 62, and the connecting patter 63, are not continuous directly with the second parts 52. In this regard, the heat may not be transferred from the first parts 51 to the second parts 52 easily; therefore, a temperature in the second parts 52 may be restrained from increasing. As a result, the synthetic resin layer 36 may be prevented from being detached from the plate 32.

Moreover, as shown in FIGS. 4 and 5, the thickness of the first parts 51 is different from the thickness of the second parts 52. In particular, the first parts 51 are formed to be thinner than the second parts 52. This arrangement may cause difficulty in the heater patterns 61 to inhibit the deformation of the dampers 6*a* more effectively. Further, the thinness in the first parts 51 may cause the heater patterns 61 to be heated more easily by the heat from the heat sources 70. Furthermore, the first parts 51 which are thinner than the second parts 52 may be easily formed by half-etching to the metallic layer.

Moreover, as shown in FIGS. 2-5, the heat sources 70 may be arranged on the both ends of the flow path unit 21 in the conveying direction. In this arrangement, the heat sources 70 are located on the outer sides of the flow path unit 21 in the direction parallel to the conveying direction in the vertically projection view. Thus, the heat sources 70 may be arranged at the positions not to interfere with the flow path unit 21.

Moreover, as shown in FIGS. 4 and 5, the dampers 36*a* and the heater patterns 61 may be covered by the cover 38. Therefore, the dampers 36*a* and the heater patterns 61 may be prevented from being exposed to external moisture or from colliding with external object such as the recording sheet P.

<More Examples>

Although an example of carrying out the invention has been described, those skilled in the art will appreciate that there are numerous variations and permutations of the liquid discharging head that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the dampers 36*a* and the heater patterns 61 may not necessarily be covered by the cover 38 from the lower side, but the cover 38 may be omitted.

For another example, the heat sources 70 may not necessarily be arranged on the both sides of the flow path unit 21 in the conveying direction. For example, the heat sources may be arranged at positions on different outer sides of the flow path unit 21 including the plates 32, 33 in a vertically projection view, such as widthwise ends of the flow path unit 21 in the sheet-width direction. For another example, the heat sources may be arranged at positions to vertically overlap the flow path unit 21 including the plate 32, 33, such as positions on an upper side or a lower side of the flow path unit 21.

For another example, the first parts 51 may not necessarily be formed to be thinner than the second parts 52, but the first parts 51 may be formed in the same thickness as the second parts 52.

For another example, the first part 51 including the heater patterns 61, the linking patterns 62 and the connecting pattern 63, to which the heat from the heat source 70 may be mainly transferred, may not necessarily be discontinuous from the second part 52, but the first part 51 may be directly continuous with the second part 52 when, for example, the first part 51 is not designed to be heated intensively.

For another example, the metal layer 37 may not necessarily have both the first part 51, which includes the heater patterns 61, the linking patterns 62, and the connecting pattern 63, and the second part 52 located within the joint area between the metal layer 37 and the plate 32, but the metal layer may have solely the first part 51.

For another example, the flow path unit 21 may not necessarily be in the arrangement such that the synthetic resin layer 36 made of a synthetic resinous material and including the dampers 36*a* is located on the lower side of the plate 32, in which the common flow paths 44 are formed, and the metal layer 37 made of a metallic material and including the heater patterns 61, the linking patterns 62, and the connecting pattern 63 is located on the lower side of the synthetic resin layer 36. For example, a first layer made of a resiliently deformable material other than the synthetic resinous material may be located on the lower side of the plate 32 in place of the synthetic resin layer 36, and parts of the first layer vertically overlapping the common flow paths 44 may serve as the dampers. For another example, a second layer made of a material other than metal and having higher heat conductivity than the first layer may be located on a lower side of the first layer so that the second layer may have the heater patterns, the linking patterns, and the connecting pattern thereon.

Further, the flow path unit 21 may not necessarily be in the arrangement such that the first layer with the dampers in the areas vertically overlapping the common flow paths 44 is located on the lower side of the plate 32 that forms the common flow paths 44, and the second layer having the heater patterns, the linking patterns, and the connecting pattern is located on the lower side of the first layer. For example, the plate 32 may be formed to have dents that may form the common flow paths on an upper side thereof, and parts of the plate 32 located on a lower side of the dents may serve as the dampers. Further, the heater patterns, the linking patterns, and the connecting patterns may be arranged on a lower side of the parts of the plate 32 that serve as the dampers.

For another example, the heater patterns 61 for each damper 36*a* may not necessarily be in the arrangement such that two heater patterns 61 extending in the sheet-width direction vertically overlap the end portions of the common flow path 44 on one side and the other side, respectively, in the conveying direction. For example, a quantity of the heater pattern(s) for each damper 36*a* may be one (1), three (3), or more. For another example, the heater pattern(s) may vertically overlap other parts of the common flow path 44 than the end portions in the conveying direction.

For another example, the heater patterns 61 may not necessarily be in the arrangement such that the two heater patterns 61 for each damper 36 are linked with the linking patterns 62, and one of the heater patterns 61 on the outer side in the direction parallel to the conveying direction is connected with the heat source 70 through the connecting pattern 63. In the following paragraph, with reference to FIG. 6, an example of another arrangement of the heater patterns will be described as a first modified example of the present disclosure.

In the first modified example, as shown in FIG. 6, heat sources 111 in a head unit 110 are each arranged on one end and the other end of the flow path unit 21 in the sheet-width direction. To each of the two dampers 36*a*, two (2) patterns 112 may be provided. One and the other of the patterns 112 may overlap one and the other end portions of the common flow path 44 in the direction parallel to the conveying direction, respectively. The patterns 112 may extend in the sheet-width direction through the entire width of the head unit 110, and each end of the patterns 112 in the sheet-width direction may be connected to one of the heat sources 111. Moreover, two (2) second parts 113 in the head unit 110 for each damper 36*a* are spaced apart from each other in the conveying direction to interpose the two patterns 112 therebetween in the conveying direction. In this arrangement, a part of each pattern 112 vertically overlapping the damper 36*a* may serve as the heater pattern, and another parts of each pattern 112 located on outer sides of the damper 36*a* in the sheet-width direction may be connected with the heat sources 111 and may serve as the connecting pattern. In this arrangement, the parts of the pattern 112 connected with the heat sources 111 may be located on outer sides of the individual flow paths 20 forming the individual flow path array 7 in the sheet-width direction. Therefore, the connecting pattern may be restrained from inhibiting deformation of the damper 36*a*.

For another example of the embodiment described earlier, the arrangement of the heater patterns 61 may not necessarily be limited to the exemplary arrangement in the embodiment described above such that the heater patterns 61 extend through the range R1, in which the individual flow paths 20 are arranged, to the ranges R2, which are on the outer sides from the range R1 in the sheet-width direction. For example, the heater patterns may extend in the sheet-width direction within the range R1 alone, in which the individual flow paths 20 are arranged.

For another example, the heater patterns 61 may not necessarily be arranged on the lower face of each damper 36*a*. In the following paragraph, with reference to FIGS. 7A and 7B, an example of another arrangement of the heater patterns will be described as a second modified example of the present disclosure.

As shown in FIGS. 7A and 7B, two (2) synthetic resin layers 121, 122, which are vertically layered, may be adhered to the lower face of the plate 32 in areas on outer sides of the plate 31 in the direction parallel to the conveying direction. Meanwhile, parts of the synthetic resin layers 121, 122 vertically overlapping the corresponding common flow path 44 may form a damper 123. Meanwhile, the heater patterns 61, the linking patterns 62, and the connecting pattern 63 for each damper 123 in the second modified example may be interposed between the synthetic resin layer 121 and the synthetic resin layer 122. In this arrangement, the heater patterns 61 are still located in a part other than an upward face of the damper 123, or the inner face of the common flow path 44. Moreover, a cover 124 may be arranged on a lower side of the synthetic resin layer 122. On an upper side of the cover 124, which is a side toward the synthetic resin layer 122, formed is a dent 124*a* at a position vertically overlapping the common flow path 44. In this arrangement, the dent 124*a* may serve as a damper chamber to absorb downward deformation of the damper 123.

For another example of the embodiment described earlier, the heater patterns 61 may be arranged on the upper face of the damper 36*a*, inside the common flow paths 44.

For another example, the damper 36*a* may not necessarily form the bottom that defines the lower end of the common flow path 44 but may, for example, form a ceiling that defines an upper end of the common flow path 44. For another example, the damper may form a wall that defines an upstream end or a downstream end of the common flow path 44 in the conveying direction.

For another example, the heater patterns may not necessarily extend in the direction substantially parallel to the sheet-width direction, which is the longitudinal direction of the dampers, but may incline at least partly at an angle smaller than 45 degrees with respect to the sheet-width direction.

For another example, the liquid discharging head in the present disclosure may not necessarily be applied to an inkjet head that may discharge ink through nozzles but may be applicable to, for example, a liquid discharging head to discharge liquified resin or metal through nozzles.

What is claimed is:

1. A liquid discharging head, comprising:

a plurality of individual flow paths, each of which includes a nozzle, the plurality of individual flow paths being arrayed in a first direction;

a common flow path extending in the first direction throughout the plurality of individual flow paths, the common flow path being connected with each of the plurality of individual flow paths;

a damper extending in the first direction throughout the plurality of individual flow paths, a part of the damper forming an inner face that defines an end of the common flow path in a second direction, the second direction being orthogonal to the first direction;

a heater pattern provided to the damper;

a heat source; and a connecting pattern connecting the heater pattern with the heat source, wherein, at least in a range in which the plurality of individual flow paths are arranged in the first direction, the heater pattern extends in the first direction without inclining with respect to the first direction at 45 degrees or larger.

2. The liquid discharging head according to claim 1, wherein the heater pattern is arranged in another part of the damper different from the part of the damper forming the inner face of the common flow path.

3. The liquid discharging head according to claim 1, wherein the heater pattern extends to an outer side of the plurality of individual flow paths in the first direction.

4. The liquid discharging head according to claim 3, wherein the connecting pattern is connected to a part of the heater pattern located on the outer side of the plurality of individual flow paths in the first direction.

5. The liquid discharging head according to claim 1, wherein the heater pattern includes two heater patterns, one and the other of which are arranged in parts of the damper overlapping one end portion and the other end portion of the common flow path in a third direction, respectively, the third direction being orthogonal to the first direction and to the second direction.

6. The liquid discharging head according to claim 1, further comprising:

a flow path member having the common flow path;

a first layer layered with the flow path member in the second direction, a part of the first layer overlapping the common flow path in the second direction forming the damper; and a second layer made of a material having higher heat conductivity than the first layer, the second layer being layered with the first layer in the second direction, wherein the heater pattern and the connecting pattern are each formed of at least a part of the second layer.

7. The liquid discharging head according to claim 6, wherein the first layer is made of a synthetic resinous material; and wherein the second layer is made of a metallic material.

8. The liquid discharging head according to claim 6, wherein the second layer includes:

a first part forming the heater pattern and the connecting pattern; and a second part located in a joint area, in which the flow path member, the first layer, and the second layer are joined, without overlapping with the common flow path in the second direction.

9. The liquid discharging head according to claim 8, wherein the first part and the second part are not directly connected with each other.

10. The liquid discharging head according to claim 8, wherein a dimension of the first part in the second direction is smaller than a dimension of the second part in the second direction.

11. The liquid discharging device according to claim 1, further comprising:

a flow path member having the common flow path, wherein the heat source is located on an outer side of the flow path member in a projection view along the second direction.

12. The liquid discharging device according to claim 1, further comprising:

a cover covering the damper and the heater pattern from a side opposite to the common flow path in the second direction.

* * * * *